US006327828B1

(12) United States Patent
Carroll

(10) Patent No.: US 6,327,828 B1
(45) Date of Patent: Dec. 11, 2001

(54) STRUCTURAL MEMBER FOR ROOF STRUCTURE OR DECK

(75) Inventor: Frank E. Carroll, Woodstock, IL (US)

(73) Assignee: Decks, Inc., Woodstock, IL (US)

( * ) Notice: Subject to any disclaimer, the term of this patent is extended or adjusted under 35 U.S.C. 154(b) by 0 days.

(21) Appl. No.: 09/561,855

(22) Filed: Apr. 28, 2000

Related U.S. Application Data

(60) Provisional application No. 60/132,030, filed on Apr. 30, 1999.

(51) Int. Cl.[7] ..... E04B 7/00; E04B 5/00

(52) U.S. Cl. ..... 52/480; 52/478; 52/506.06; 52/508

(58) Field of Search ..... 52/478, 479, 480, 52/506.05, 506.07, 508, 22, 407.3, 729.5, 731.7, 733.3, 506.06, 90.2

(56) References Cited

U.S. PATENT DOCUMENTS

| | | | | |
|---|---|---|---|---|
| 2,767,440 | * | 10/1956 | Nelsson | 52/506.07 X |
| 3,055,466 | * | 9/1962 | Brown | 52/506.07 X |
| 3,276,179 | * | 10/1966 | Rallis | 52/508 X |
| 3,303,624 | * | 2/1967 | Swain | 52/506.07 |
| 3,462,901 | * | 8/1969 | Jamgochian | 52/478 X |
| 3,740,912 | * | 6/1973 | Sauer et al. | 52/479 |
| 3,934,387 | * | 1/1976 | Moeller | 52/506.07 |
| 4,040,758 | * | 8/1977 | Sauer | 52/506.07 X |
| 4,044,521 | * | 8/1977 | Fischer et al. | 52/478 X |
| 4,384,437 | * | 5/1983 | Coles | 52/506.06 X |
| 4,875,320 | * | 10/1989 | Sparkes | 52/489.1 |

FOREIGN PATENT DOCUMENTS

| | | | | |
|---|---|---|---|---|
| 1227191 | * | 8/1960 | (FR) | 52/506.07 |
| 2093886 | * | 8/1960 | (GB) | 52/729.5 |

* cited by examiner

*Primary Examiner*—Robert Canfield
(74) *Attorney, Agent, or Firm*—Pauley Petersen Kinne & Fejer

(57) ABSTRACT

A structural member having a top flange, a web and a bottom support. The top flange transitions into the web and the web transitions into the bottom support. The overall height of the structural member varies to accommodate structural panels, including insulation and acoustical panels, of similar or different thicknesses. In one preferred embodiment, an apparatus having a plurality of structural members attached to corresponding bearing plates is used as a sub-purlin to provide an economical roofing system which allows for retrofitting and easy detection and replacement of damaged roofing panels.

10 Claims, 3 Drawing Sheets

ROOF DESIGN LOAD - 50 P.S.F.

| SAFE SINGLE SPAN | D | GAGE | WT/FT | AREA | AXIS-X-X | | | AXIS-Y-Y | | | SPAC-ING |
|---|---|---|---|---|---|---|---|---|---|---|---|
| | | | | | tx | Sx | rx | Iy | Sy | ry | |
| Ft. | In. | No. | Lbs. | Sq. in. | in4 | in3 | in | in4 | in3 | in | in |
| 4.5 | 1 1/2 | 16 | 1.46 | 0.43 | 0.114 | 0.102 | 0.543 | 0.269 | 0.179 | 0.790 | 24 |
| 5.5 | 2 | 16 | 1.57 | 0.46 | 0.224 | 0.153 | 0.733 | 0.269 | 0.179 | 0.764 | 24 |
| 7.4 | 3 | 16 | 1.77 | 0.52 | 0.585 | 0.277 | 1.109 | 0.269 | 0.179 | 0.719 | 24 |
| 9.2 | 4 | 16 | 1.97 | 0.58 | 1.167 | 0.427 | 1.476 | 0.269 | 0.179 | 0.681 | 24 |
| 10.9 | 5 | 16 | 2.18 | 0.64 | 2.005 | 0.602 | 1.835 | 0.269 | 0.179 | 0.645 | 24 |
| 12.7 | 6 | 16 | 2.38 | 0.70 | 3.031 | 0.801 | 2.186 | 0.269 | 0.179 | 0.620 | 24 |

FIG. 4

STRUCTURAL MEMBER FOR ROOF STRUCTURE OR DECK

CROSS REFERENCE TO RELATED APPLICATION

This application claims the benefit of U.S. Provisional Application No. 60/132,030, filed Apr. 30, 1999.

BACKGROUND OF THE INVENTION

1. Field of the Invention

This invention relates to a structural member that has a cross-sectional shape which accommodates insulation and/or acoustical panels. The overall height of the structural member can be selected as a function of different thicknesses of one or more panels. Two or more structural members can be attached to bearing plates or sub-purlins, to provide an economical roofing system which can be easily constructed and/or retrofitted.

2. Description of Related Art

Conventional support members used in roofing structures, for example sub-purlins, can have an I-beam shaped cross-section. After support members are fastened to a purlin, insulation panels or other structural panels are positioned between adjacent support members. A top flange of a support member having an I-beam shaped cross-section can interfere with a structural panel during an installation process. As a result, for example if one of the panels is damaged or cracked, or if the roof is leaking, it is difficult to remove an installed structural panel. Replacing the damaged panel or repairing the roof structure can thus be expensive and time consuming.

It is apparent that there is a need for a structural member that can support roof structures or decks and that facilitates easy and inexpensive replacement of damaged panels and/or retrofit of existing roof structures.

SUMMARY OF THE INVENTION

It is an object of this invention to provide a structural member having sufficient strength to support roof panels and structures.

It is another object of this invention to provide a structural member that has an upper flange shape which provides increased dimensional clearance capabilities.

It is another object of this invention to provide a structural member that facilitates retrofitting, for example with additional insulating or acoustical panels.

The above and other objects of this invention are accomplished with a structural member, for example one which is marketed as a TRI COM® Zee structural member, having a top flange, a web and a bottom support. The bottom support has a first bottom flange that transitions into a second bottom flange which overlaps and contacts or is adjacent the first bottom flange. The overall height and width of the structural member, and/or the width of the top flange may be selected or designed as needed for different applications or structures.

The structural member can be of a galvanized steel, a similar material, aluminum, graphite and/or other metal or non-metal composites strong enough to support roof structures or decking. During the fabrication process of a structural member according to this invention, a continuous sheet, piece or plate of material is bent at a first end portion to form the top flange and is bent at a second end portion to form the bottom support. The bottom support is bent about 180° so that at least a portion of the second bottom flange overlaps and contacts or is adjacent the first bottom flange. The second bottom flange preferably extends from the bend up to and beyond the web.

The fabricated structural member is particularly suitable for use as a sub-purlin. A structural panel, such as a gypsum board, an insulating panel or an acoustical panel, is placed between two adjacent structural members. The structural panel is supported by a portion of each of two of the bottom supports, those facing each other, of adjacent structural members. The structural panel can be easily positioned between the adjacent structural members because the top flange extends only from one side of the web. During installation, a first end portion of the structural panel is inserted between the top flange and the bottom support of one structural member. The bottom flange supports a bottom surface of the first end portion of the inserted panel. After the first end portion of the panel is positioned, an opposite second end portion of the structural panel is then lowered into position against the bottom support of another adjacent structural member. During installation, the second end portion of the structural panel does not interfere with the top flange of the other adjacent structural member. Because the second end portion of the panel can be inserted between adjacent structural members with no interference, a damaged panel is easily removed and replaced.

In one preferred embodiment of this invention, an apparatus including a plurality of structural members used in conjunction with independent bearing plates forms a fire-retardant roofing system particularly beneficial for re-roofing procedures.

To begin the re-roofing procedure, the existing roofing and structural panels are removed, leaving the roof deck in place. Bearing plates can be positioned on the existing roof deck and fastened through the existing roof deck, for example into a roof joist. Preferably, the bottom support of the structural member is fastened to the bearing surface of the bearing plate. Alternatively, the structural member is fastened directly to the existing roof joist Insulation, acoustical and/or other structural panels are placed between two adjacent structural members and a roofing deck is then fastened to the top flanges.

The structural member and apparatus of this invention provide distinct advantages over conventional steel roof decks, including the ability to construct a new roof without removing the old roof; easy repair of leaks and replacement of damaged structural panels; and the ability to install insulation, acoustical and/or other structural panels after initial construction.

BRIEF DESCRIPTION OF THE DRAWINGS

The drawings show different features of a structural member and an apparatus for supporting a roofing structure or deck, according to preferred embodiments of this invention, wherein:

FIG. 4 shows Roof Design Loads for a roofing system having G-90 16-gauge galvanized steel structural members with a height between about 1.5 inches and about 6.0 inches.

DETAILED DESCRIPTION OF PREFERRED EMBODIMENTS

Figure 1:
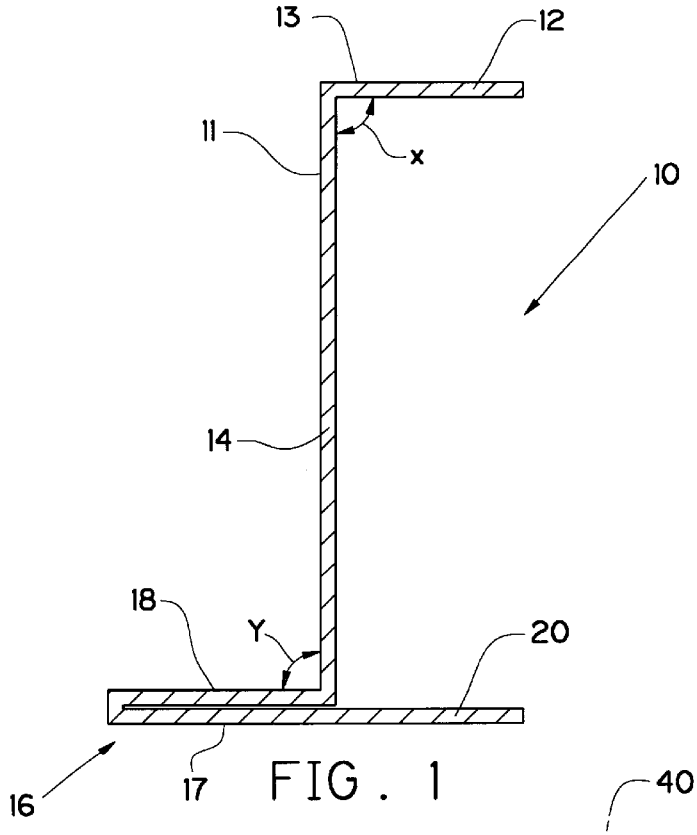
FIG. 1 is a cross-sectional side view of a structural member, according to one preferred embodiment of this invention.
Figure 2:
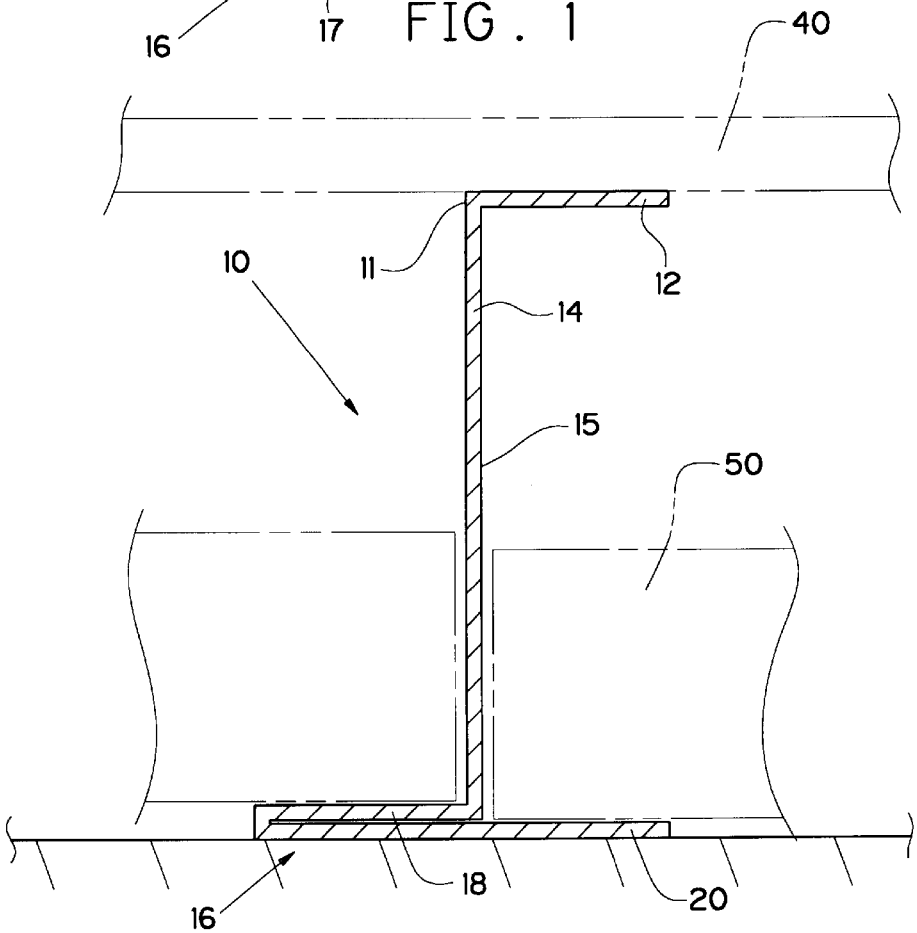
FIG. 2 is a cross-sectional side view of a structural member attached to a portion of a roof structure, according to one preferred embodiment of this invention.

A structural member 10, according to one preferred embodiment of this invention is shown in FIG. 1. Structural member 10 comprises a top flange 12, a web 14, and a bottom support 16. In one preferred embodiment, bottom support 16 further comprises a first bottom flange 18 and a second bottom flange 20. Preferably, but not necessarily, first bottom flange 18 transitions into second bottom flange 20. Second bottom flange 20 is adjacent first bottom flange 18 so that at least a portion of second bottom flange 20 overlaps and contacts or is adjacent first bottom flange 18, as shown in FIG. 1. Second bottom flange 20 is preferably, but not necessarily, longer than first bottom flange 18 and a portion of second bottom flange 20 extends from the bend up to and beyond web 14, as shown in FIGS. 1 and 2, to provide additional structural support for structural member 10.

As shown in FIG. 1, a first angle X is formed between top flange 12 and web 14. A second angle Y is formed between web 14 and bottom support 16. Preferably, first angle X and second angle Y each is about 90° or generally perpendicular to web 14. In one preferred embodiment of this invention, first angle X and second angle Y are congruent, with top flange 12 generally parallel to bottom support 16. Depending on the particular use for structural member 10, congruent first angle X and second angle Y may be acute or obtuse to any degree suitable for a desired structural strength.

Preferably, but not necessarily, the overall height of structural member 10 for a typical roof structure is about 1.0 inch to about 8.0 inches, more preferably about 1.5 inches to about 6.0 inches and the overall width of structural member 10 is about 3.0 inches. However, the dimensions can vary to any extent to accommodate different load requirements. The term overall height as used throughout this specification and in the claims refers to the distance from a top surface 13 of top flange 12 to a bottom surface 17 of bottom support 16. The overall height and/or the overall width of structural member 10 may be increased or decreased as needed for achieving a desired structural strength, as apparent to those skilled in the art. For example, the overall height of structural member 10 may be chosen as a function of the load capacity associated with different gauges of materials for steel decking. Additionally, the width of structural member 10 may be increased or decreased, for example as the height of structural member 10 is increased or decreased or as the distance between successive structural members 10 is increased or decreased.

Figure 3:
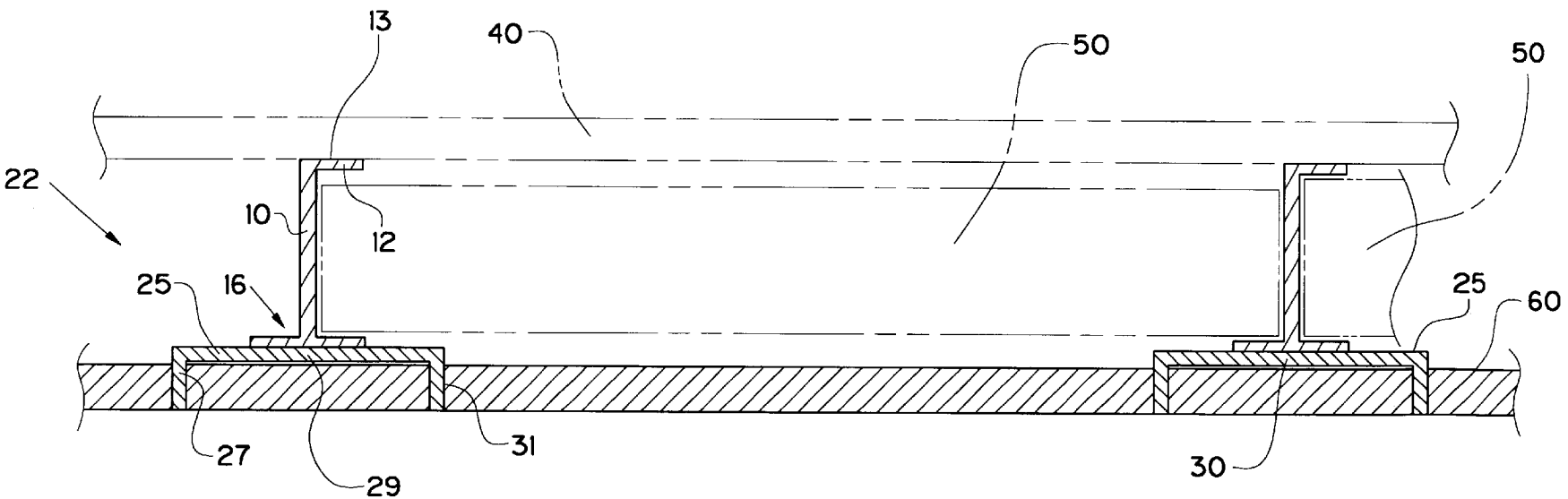
FIG. 3 is a cross-sectional side view of a system for supporting a roofing structure or deck, according to one preferred embodiment of this invention.

Structural member 10 is preferably, but not necessarily, fabricated from G-90 16-gauge galvanized steel or a similar material. Structural member 10 may also be fabricated from other materials including aluminum and graphite and/or other metal or non-metal composites capable of supporting roof decking. During the fabrication process, a continuous sheet, piece or plate of material is bent, roll-formed or otherwise shaped at a first end portion to form top flange 12. Preferably, top flange 12 is generally perpendicular to a first end portion of web 14. The plate material is then bent, roll-formed or otherwise shaped at a second end portion to form bottom support 16, which is preferably perpendicular to a second end portion of web 16. As shown in FIGS. 1–3, first bottom flange 18 projects in an opposite direction, relative to a direction in which top flange 12 projects from web 14. Bottom support 16 is then bent, roll-formed or otherwise shaped about 180° so that at least a portion of second bottom flange 20 overlaps and contacts or is adjacent first bottom flange 18. When a load is applied to structural member 10, at least a portion of second bottom flange 20 contacts first bottom flange 18.

As shown in FIG. 2, fabricated structural member 10 is particularly suitable for use as a sub-purlin. The term sub-purlin as used throughout this specification and in the claims refers to a conventional structural member for carrying loads from roofing materials, supported by and running at right angles to purlins. For example, successive structural members 10 can be spaced apart from each other, preferably, but not necessarily, at 24 inches on center, and fastened to a roof structure, for example a roof joist or purlin. In one preferred embodiment of the invention, bottom support 16 is secured or otherwise fastened to a roof structure by means for attaching, including welding, clamps and/or screws. However, other suitable means for attaching known to those skilled in the art may be used to secure bottom support 16 to a roof structure. Top flange 12 can support steel decking, plywood decking and/or any other suitable decking 40, for example at spans of up to about 15 feet. Bottom support 16 can support many types and sizes of insulation and acoustical panels 50. Thus, for example, structural member 10 can be used to replace top chord joist bridging angles.

For example, as shown in FIG. 2, a series of steel structural members 10 can be attached to a roof at 24 inches on center. A structural panel, such as a gypsum board, an insulating panel or an acoustical panel, is placed between successive structural members. Suitable panels include, for example, a FIBREX® insulation panel having a thickness of about 1.5 inches to about 4.0 inches, a width of about 24 inches and a length of about 96 inches. The structural panel is supported by bottom support 16 of adjacent structural members 10. First bottom flange 18 of one structural member 10 and second bottom flange 20 of a second adjacent structural member 10 contact and support the panel in position.

The structural panel 50 can be easily positioned between the successive structural members 10 because top flange 12 extends only from one side of web 14, as shown in FIGS. 1–3. A first end portion of the structural panel 50 is inserted between top flange 12 and second bottom support 20, for example so that the structural panel 50 contacts an inner surface 15 of web 14. Second bottom flange 20 supports a bottom surface of the inserted structural panel 50. After the first end portion of the structural panel 50 is positioned against inner surface 15, a second end portion of the structural panel 50 is lowered into position along a back surface 11 of adjacent structural member 10. Because structural member 10 of this invention has only one top flange 12, when lowered into position, the second end portion of the structural panel 50 has increased clearance with respect to structural member 10. The second end portion is supported in position by first bottom flange 18 of adjacent structural member 10. Because the second end portion of the structural panel 50 is inserted between adjacent structural members 10 without interference, a damaged panel is easily removed or dismantled. After initial construction is completed, additional insulation panels may be inserted between successive structural members 10 without removing structural member 10.

After the structural panels 50 are positioned between successive structural members 10, a decking is positioned over successive structural members 10. The decking is supported by top surface 13 of top flange 12 and fastened to top flange 12 or structural member 10 using conventional means for attaching, for example screws, welding, clamps or the like.

As shown in FIG. 2, the height of web 14 may be selected or designed to provide adequate spacing between top flange 12 and second bottom flange 20 to insert and support structural panels 50 of varying thicknesses. In one preferred embodiment of this invention, the width of top flange 12 is preferably about 1.5 inches. However, the width can be any other suitable dimension that accommodates a suitable structural strength for given conditions.

FIG. 3 shows a system 22 according to one preferred embodiment of this invention, including a plurality of structural members 10 used in conjunction with independent bearing plates 25, for example to form a fire-retardant roofing system using re-roofing procedures. As shown in FIG. 3, bearing plate 25 comprises a first leg 27, a bearing surface 29, and a second leg 31. Bearing plate 25 can be fabricated from any suitable material, including but not limited to aluminum and graphite and/or other metal or non-metal composites capable of supporting decking.

Referring to FIG. 3, to begin the re-roofing procedure, the existing roofing and/or underlying structural panels are removed, sometimes leaving the roof deck 60 in place. A plurality of successive bearing plates 25 are positioned, preferably, but not necessarily, 24 inches on center, and fastened on the existing roof deck. In one preferred embodiment of this invention, bottom support 16 of structural member 10 is fastened at 24 inches on center to corresponding bearing surface 29 of bearing plate 25 by attachment means well known in the art, for example by welding or with screws. Preferably, each structural member 10 is welded to corresponding bearing plate 25.

In one preferred embodiment of this invention, structural member 10 is fastened or attached directly to the existing roof joist. A plurality of apertures or slots 30 are formed in bearing surface 29, allowing the screws to pass through bearing surface 29 and the existing roof deck and into the roof joist. A structural panel 50, such as insulation that resists combustion, or an acoustical panel, is preferably placed between successive structural members 10. A roofing deck 40, such as one including DRICON® plywood or another suitable fire-resistant plywood, is then fastened to top surface 13 of top flanges 12, as shown in FIG. 3. Preferably, the roofing deck 40 has a span of about 2 feet to about 15 feet. After the roofing deck 40 is fastened to structural members 10, a roof covering may be applied to the roofing deck 40. In one preferred embodiment of this invention, gypsum board is attached to inner surface 15 and back surface 11 of each structural member 10 to make system 22 fire resistant.

System 22 provides distinct advantages over conventional steel roof decks. The use of the structural member 10 in system 22 allows: construction of a new roof without removal of the old roof deck; easy repair of leaks and replacement of damaged panels; and installation of structural panels after initial construction is completed. Unlike a system using structural members 10, conventional steel roof decks cannot be retrofitted with additional insulation or acoustical panels. FIG. 4 shows the roof design load when G-90 16-gauge galvanized steel structural members 10 having an overall height which varies from about 1.5 inches to about 6.0 inches are used for system 22.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

I claim:

1. A system for supporting roof decking, comprising:

a plurality of structural members, each of said structural members welded to an independent bearing plate;

each of said structural members further comprising a top flange, a web having a first end portion and a second end portion, and a bottom support;

said top flange positioned perpendicular to said first end portion of said web;

said bottom support positioned perpendicular to said second end portion of said web; and said bottom support having a first bottom flange and a second bottom flange.

2. A system according to claim 1 wherein each of said structural members has an overall height of about 1.0 inch to about 8.0 inches.

3. A system according to claim 1 wherein each of said structural members has an overall height of about 1.5 inches to about 6.0 inches.

4. A system according to claim 1 wherein each of said structural members and said bearing plates are fabricated from at least one of a galvanized steel, an aluminum, a graphite, a metal composite and a non-metal composite.

5. A system according to claim 1 wherein said first bottom flange transitions into said second bottom flange.

6. A system according to claim 1 wherein at least a portion of said second bottom flange contacts said first bottom flange.

7. A system according to claim 1 wherein a portion of said second bottom flange extends beyond said web.

8. A system according to claim 1 wherein each said bearing plate further comprises a first leg, a bearing surface, and a second leg, said first leg connected to a first end portion of said bearing surface and said second leg connected to a second end portion of said bearing surface.

9. A system according to claim 1 wherein said bearing plate has a plurality of slots.

10. A system according to claim 1 wherein said structural member and said bearing plate each is fabricated from a continuous piece of galvanized steel.

* * * * *